United States Patent [19]

Laapotti

[11] Patent Number: 4,767,501

[45] Date of Patent: Aug. 30, 1988

[54] METHOD FOR EQUALIZING COMPRESSION PRESSURE IN A PRESS NIP OF A PAPER MACHINE

[75] Inventor: Jorma Laapotti, Palokka, Finland

[73] Assignee: Valmet Oy, Finland

[21] Appl. No.: 816,315

[22] Filed: Jan. 6, 1986

[30] Foreign Application Priority Data

Jan. 8, 1985 [FI] Finland ..... 850087

[51] Int. Cl.[4] ..... D21F 3/02

[52] U.S. Cl. ..... 162/205; 162/305; 162/358

[58] Field of Search ..... 162/205, 358, 360.1, 162/305; 29/132

[56] References Cited

U.S. PATENT DOCUMENTS

| | | | |
|---|---|---|---|
| 3,306,814 | 2/1967 | McHugh | 162/358 |
| 4,229,253 | 10/1980 | Cronin | 162/361 |
| 4,229,254 | 10/1980 | Gill | 162/358 |
| 4,483,745 | 11/1984 | Wicks et al. | 162/358 |
| 4,526,655 | 7/1985 | Karvinen et al. | 162/360.1 |
| 4,555,306 | 11/1985 | Lundstrom | 162/358 |

FOREIGN PATENT DOCUMENTS 3324408 2/1984 Fed. Rep. of Germany .

*Primary Examiner*—David L. Lacey
*Assistant Examiner*—K. M. Hastings
*Attorney, Agent, or Firm*—Steinberg & Raskin

[57] ABSTRACT

An arrangement for equalizing the compression pressure acting on a web passing through a paper machine press nip formed by two opposed press rolls and through which of at least one press fabric passes. At least one resilient loop component passes through the press nip, the resilient loop component having an outer surface facing the web whose hardness is within the range of between 10 to 80 P & J by means of which small-size variations in the compression pressure acting on the web in the range of up to about 6 mm are equalized. The resilient loop component has a framework layer within its thickness whose hardness is substantially greater than the hardness of the outer surface which faces the web by means of which larger variations in the compression pressure acting on the web are equalized. A press section incorporating the arrangement is also disclosed.

9 Claims, 4 Drawing Sheets

METHOD FOR EQUALIZING COMPRESSION PRESSURE IN A PRESS NIP OF A PAPER MACHINE

BACKGROUND OF THE INVENTION

The present invention relates generally to arrangements in paper machine press sections for equalizing the compression pressure in a press nip.

More particularly, the invention relates to a method in a paper machine press section by which compression pressure in a press nip is equalized, in which method the paper web is passed through at least one press nip formed by two opposed press rolls and through which at least one water-receiving press fabric is passed for receiving water pressed from the web in the press nip.

The invention further relates to a paper machine press section comprising at least one press nip formed between two opposed press rolls and wherein at least one water-receiving press fabric passes through the nip.

The invention additionally relates to a resilient loop component, which may comprise a resilient belt and/or a corresponding resilent coating of a press roll, which passes through a paper machine roll press or an extended-nip roll press and which is formed at least in part of elastic material.

Press sections of paper machines generally comprise one or more press nips through which the web runs in contact with or between one or a pair of press felts. The press felts generally comprise a woven framework layer onto the side surfaces of which nap layers of fibrous material are applied by pinning. Such conventional press felts have several drawbacks such, for example, as limited wear resistance. Moreover, the properties of the press felts tend to change during operation as the felts wear.

A substantial drawback of conventional press felts is that they tend to apply compression pressure to the fiber network of the web in an uneven fashion so that even under best circumstances the pressure is applied to the web only over about 30% of the area that is being compressed. The uneven distribution of the compression pressure results largely from the coarseness of the surface of the nap layer of the press felt, from the differences in compression applied by the felt caused by the yarns in the framework layer of the press felt, and from variations in the thickness of the press felt over a wider area thereof. The differences in compression pressure also are the result of the roughness of the surface of the press roll, for example a rock roll, by deviations in the shape of the surface of the press roll and by the bores or grooves present in hollow-surface press rolls.

It can be shown experimentally that if a uniform surface pressure is applied to the paper web being compressed, for example by using porous, smooth sinter sheets rather than conventional press felts, the dry solid content of the web is improved from about 45%, obtained by conventional press felts, to about 70%.

SUMMARY OF THE INVENTION

It is an object of the present invention to provide new and improved resilient loop components and press sections incorporating the same by means of which both small-scale and large-scale variations in the compression pressure acting on the web in a press nip are equalized relative to the variations obtained using only conventional press fabrics or felts to thereby improve dewatering efficiency so that the web leaving the press section is more highly dewatered than has been possible heretofore. In this manner, the proportion of dewatering by evaporation is reduced thereby substantially reducing the energy costs of running the paper machine.

Another object of the invention is to provide new and improved methods and apparatus for equalizing the compression pressure acting on a web in a press nip of a paper machine and press sections incorporating the same by which a more uniform web can be obtained. A more uniform web is important especially in the case of the thinner paper qualities which have recently been introduced. In particular, a more uniform homogeneous web reduces the risk of web breakage since it is usually the weakest portion of the web that causes the break. A more uniform web also improves the grammage properties of the paper.

Briefly, in accordance with the present invention, these andother objects are attained by providing a method wherein one or more resilient loop components are passed through the press nip or nips, the resilient loop component being in the form of a resilient-band loop and/or a reslient-coating ring applied around at least one of the press rolls. The surface of the resilient loop component which faces the web has a hardness within the range of between about 10 to 80 P & J by means of which small-size variations in the compression pressure acting on the web in the range of up to about 6 mm are equalized. Note all P & J values are based on $\frac{1}{8}$ inch scale. The resilient loop component also includes a framework layer which is substantially harder than the hardness of the web-facing surface. The framework layer of the resilient loop component acts to equalize larger scale variations in compression pressure.

The objects of the invention are also attained by providing a press section wherein at least one resilient loop component is passed through the press nip, the resilient loop component comprising a resilient-band loop and/or a resilient-coating ring applied around a press roll, the hardness of the outer surface of the resilient loop component which faces the web being within the range of between about 10 to 80 P & J and preferably within the range of between about 20 to 40 P & J.

The objects of the invention are also attained by providing a resilient loop component for use in the method and press section of the invention which is characterized by an outer surface adapted to face the web whose hardness is in the range of between about 10 to 80 P & J for equalizing the small-scale variations in the compression pressure in the nip. The resilient loop component is also characterized by a framework layer within its thickness which is substantially harder than the hardness of the outer surface of the resilient loop component to equalize larger scale variations in the compression pressure and which, additionally, provides the resilient loop component with the required mechanical strength and dimensional stability.

The resilient loop component of the invention, i.e. the resilient belt or resilient coating used in the method of the invention, has a layered structure comprising a soft surface layer which equalizes the small-scale variations in compression pressure and a harder, and usually thicker, framework layer which equalizes larger-scale compression pressure variations. The harder framework layer also provides the resilient loop component with the necessary strength and dimensional stability. It is understood that a layered structure does not necessarily mean that the resilient loop component has discrete, separately identifiable layers in the thickness direction. Rather, the properties of the layers, such as hardness and porosity, may vary continuously, and not in stepwise increments, in the thickness direction of the resilient loop component.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
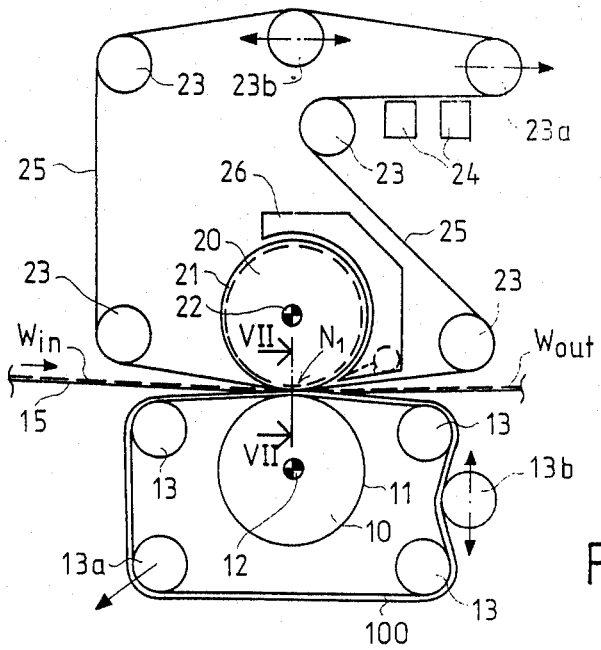
FIG. 1 is a schematic side elevation view of one embodiment of a press section in accordance with the invention for performing a method in accordance with the invention and wherein a resilient-band loop in accordance with the invention is utilized.

Referring now to the drawings wherein like reference character designate identical or corresponding parts throughout the several views, and more particularly to FIG. 1, a press section in accordance with the invention for performing a method in accordance with the invention is illustrated. The press nip $N_1$ is formed between a lower press roll 10 and an upper press roll 20. The press roll 10 has a smooth face 11 and is provided with a drive 12 while the upper press roll 20 has a hollow face 21, such as a grooved or blind-drilled face, and is provided with a drive 22. A water collecting trough 26 is provided over upper press roll 20. The web $W_{in}$ entering press nip $N_1$ is supported on a transfer felt, transfer belt or dewatering felt 15 whose surface properties are such that the web $W_{out}$ leaving the nip $N_1$ follows along with fabric 15.

A water-receiving upper fabric or felt 25 runs through nip $N_1$. The felt 25 is guided by guide rolls 23, a tensioning roll **23*a* and an alignment roll 23*b*. Felt reconditioning devices are designated 24**.

In accordance with the invention, a resilient loop component 100 passes through nip $N_1$. In the illustrated embodiment, the resilient loop component comprises a resilient-band loop or belt 100 surrounding the lower press roll 10 guided by guide rolls 13, a tensioning roll **13*a* and an alignment roll 13*b*. The resilient belt 100** is formed of an elastic material and has a construction and properties in accordance with the invention described in detail below.

Figure 2:
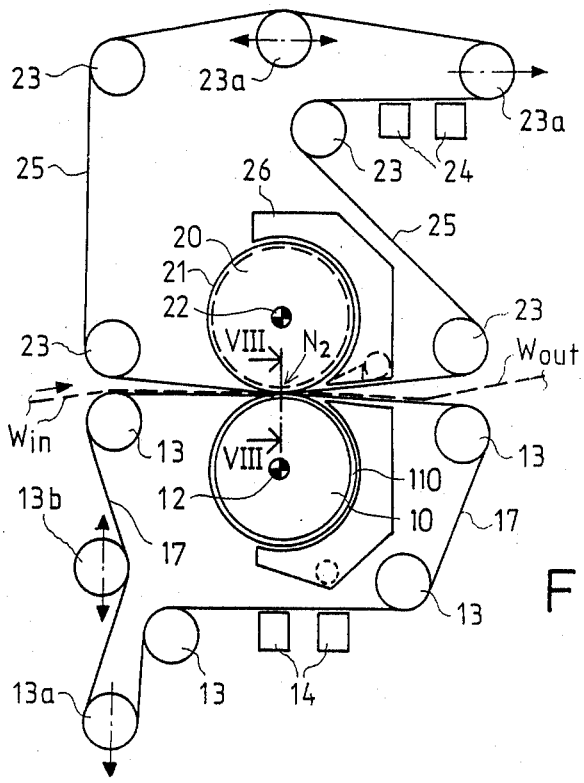
FIG. 2 is a schematic side elevation view of a second embodiment of a press section in accordance with the invention and wherein a resilient-coating ring is applied to the lower press roll and wherein two press felts are provided.

Referring to the embodiment of FIG. 2, the press nip $N_2$ is formed between a lower roll 10 and an upper roll 20 having a hollow face 21. The upper elements of the press section are similar to those described above in connection with FIG. 1. A dewatering felt 17 runs around roll 10. The felt 17 has surface properties such that the web W will follow along with felt 17 after the press nip $N_2$ for transfer either to the drying section of the paper machine or to the next press nip.

In the embodiment of FIG. 2, the resilient loop component comprises a resilient-band loop or coating 110 applied around the lower press roll 10.

Figure 3:
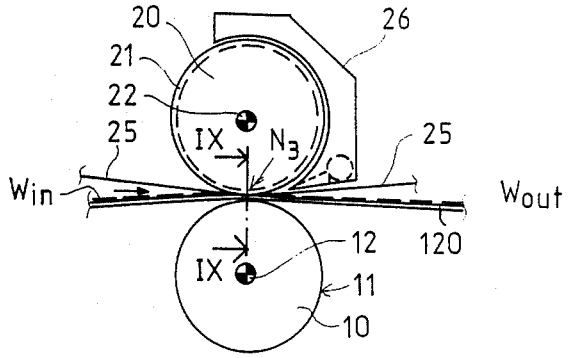
FIG. 3 is a schematic side elevation view of a third embodiment of a press nip of a press section in accordance with the invention and wherein a resilient band or belt in accordance with the invention also acts to carry the paper web to the next nip or to the drying section.

Referring to the embodiment of FIG. 3, a resilient loop component in the form of a resilient belt 120 is used which may also act as a carrier of the web W to the next nip or directly to the drying section as a closed draw. The lower roll 10 of nip $N_3$ has a smooth face 11 and is provided with a drive 12. The upper press roll 20 around which a dewatering felt 25 runs has a hollow face 21 and is provided with a drive 22 as well as a water collecting trough 26.

Figure 4:
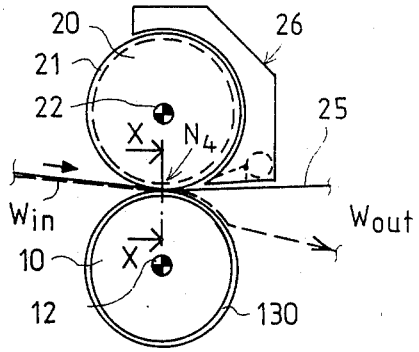
FIG. 4 is a schematic side elevation view of a fourth embodiment of a press nip of a press section in accordance with the invention in which a resilient-coating ring is accordance with the invention is applied around the lower press roll and which includes a dewatering felt, the lower press roll acting to carry the web out of the nip from where it passes as an open draw to the next nip or to the drying section.

Referring to the embodiment of FIG. 4, the resilient loop component takes the form of a resilient coating 130 applied around the lower press roll 10. The nip $N_4$ is formed between the lower roll 10 and an upper roll 20 having a hollow face 21. A dewatering felt 25 runs through the nip $N_4$ above the web. The surface properties of the resilient coating 130 are selected so that it also functions to carry the web $W_{out}$ as the web exits from nip $N_4$.

Figure 5:
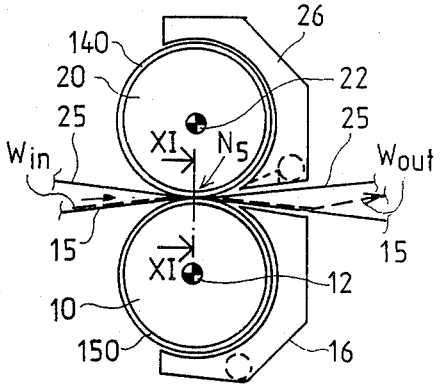
FIG. 5 is a schematic side elevation view of a fifth embodiment of a press nip of a press section in accordance with the invention, provided with two dewatering felts, and wherein both of the press rolls are provided with a resilient-coating ring in accordance with the invention.

Referring to the embodiment of FIG. 5, the resilient loop component takes the form of a resilient coating 150 applied around the lower press roll 10 and a resilient coating 140 applied around the upper press roll 20. By providing two opposed resilient coatings 140 and 150, the nip $N_5$ can be a relatively long nip, if required. A dewatering felt 25 passes through nip $N_5$ above the web while another dewatering felt 15 passes through the nip $N_5$ below the web. The resilient coating 150 may be provided with a hollow face as described in greater detail below. Press rolls 10 and 20 are provided with water collecting troughs 16 and 26 respectively. The web $W_{in}$ enters nip $N_5$ supported by felt 15 and leaves the nip $N_5$ supported on the same felt for transfer either into the next press nip or directly to the drying section of the paper machine.

Figure 6:
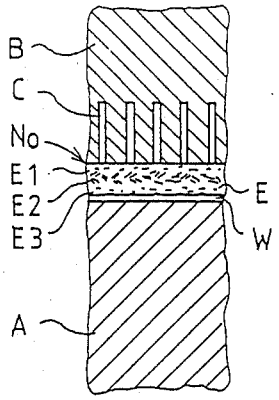
FIG.6 PRIOR ART
FIG. 6 is an axial sectional view illustrating a prior art press nip having the drawbacks discussed above.

Before describing the illustrated embodiments of the resilient loop components in accordance with the invention, reference is made to FIG. 6 wherein a conventional press nip $N_o$ is illustrated. The press nip $N_o$ is formed between a lower press roll, e.g. a rock roll A or the like, and an upper press roll B, which may comprise a steel roll provided with grooves C. A convential felt E passes through nip $N_o$. The felt E comprises a framework layer $E_2$ and nap layers $E_1$ and $E_3$ applied to both side surfaces of the framework layer. When a paper web W runs through nip $N_o$, a small-scale variation in the distribution of the compression pressure will always exist and a large-scale variation in the compression pressure will frequently exist. These variations in the compression pressure result in the various drawbacks discussed above. The nip $N_o$ is relatively short in the direction of web run and the web W may spend an insufficient time in the nip to obtain desired dewatering. The length of the nip $N_o$ is generally within a range of between about 20 to 30 mm.

Reference will now be made to FIGS. 7 to 11 which are axial sectional views of the nips $N_1$ to $N_5$ shown in FIGS. 1–5.

Figure 7:
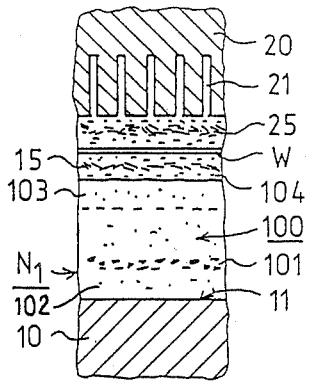
FIG. 7 is a sectional view taken along line VII—VII of FIG. 1.

As seen in FIGS. 1 and 7, the resilient belt 100 running through nip $N_1$ comprises a framework layer 101, a harder layer 102 contacting the smooth press roll 10 and a softer layer 103 having an outer surface which faces the web W and contacts the press felt 16.

Figure 8:
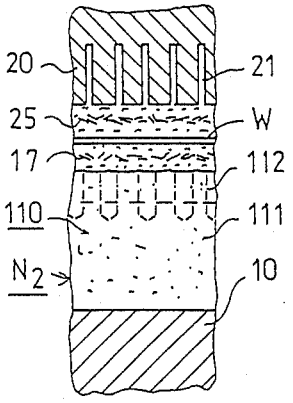
FIG. 8 is a sectional view taken along line VIII—VIII of FIG. 2.

As seen in FIGS. 2 and 8, the lower press roll 10 of nip $N_2$ is provided with a resilient coating 110. The resilient coating 110 has a harder layer 111 on the side of roll 10 and a softer layer 112 situated outwardly of layer 111 and having an outer surface facing the web W and contacting the press or transfer felt 17. The resilient coating 110 may also be provided with a hollow face such, for example, as by grooves or blind-drilled bores.

Figure 9:
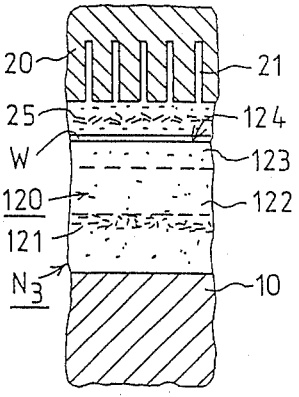
FIG. 9 is a sectional view taken along line IX—IX of FIG. 3.

Referring to FIGS. 3 and 9, the resilient belt 120 runs through nip $N_3$. The resilient belt 120 is provided with a reinforcement structure in the form of a net-like structure 121 which provides the belt 120 with a high degree of strength. The resilient belt 120 has an inner hard layer 122 at its side which faces the smooth-faced press roll 10 and an outer softer layer 123 having a smooth outer surface 124 which is in direct contact with the paper web W.

Figure 10:
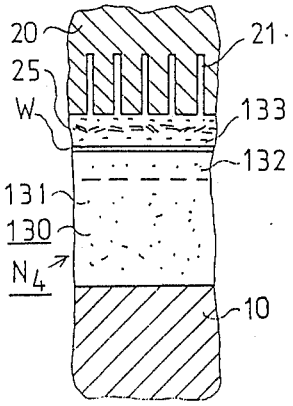
FIG. 10 is a sectional view taken along line X—X of FIG. 4.

As seen in FIGS. 4 and 10, the lower press roll 10 of nip $N_4$ is provided with a resilient coating 130 having a harder inner layer 131 and a softer outer layer 132 having a smooth outer surface 133 which is in contact with the paper web W.

Figure 11:
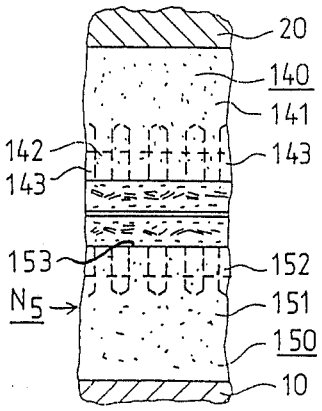
FIG. 11 is a sectional view taken along line XI—XI of FIG. 5.

As seen in FIGS. 5 and 11, the press rolls 10 and 20 of nip $N_5$ have resilient coatings 150 and 140. The coating 140 of roll 20 has a harder inner layer 141 and a softer outer layer 142 which may be provided with a hollow construction such as by forming grooves or bores therein. Similarly, the coating 150 of roll 10 has a harder inner layer 151 and a softer outer layer 152 and a soft hollow outer surface 153.

The thickness of the resilient belts 100 and 120 described above is preferably within the range of between about 5 to 25 mm, and most preferably in the range of between about 8 to 15 mm. The belts are formed, for example, of rubber and/or polyurethane and may be provided with necessary reinforcement structures, such as fabrics.

The hardness of the outer surface of the belts 130, 120 facing the web in accordance with the invention and which contact either the press felt 15 or the paper web W directly is within a range of between about 10 to 80 P & J, and most preferably within the range of between about 20 to 40 P & J. The remaining cross-sectional area or thickness of the belts 100, 120 has a hardness in the range of between about 5 to 30 P & J and most preferably in the range of between about 10 to 20 P & J. The belts 100, 120 cannot be very hard since it must bend during its run. The strength and durability of the belts 100, 120 should also be sufficient for the intended purpose.

The thickness of the resilient coatings 130, 140, 150 in accordance with the invention provided on press rolls 10, 20 is preferably within a range of between about 10 to 40 mm and most preferably within a range of between about 12 to 25 mm. The coating is made, for example, of rubber and/or polyurethane in a suitable layered structure. A reinforcement, such as a net-like structure, is situated within the resilient coating, if necessary. The hardness of the outer surface of the roll coatings 110, 130, 140, 150 facing the web and contacting either the press felt 17 (FIG. 2), 15, 25 (FIG. 5) or the paper web directly is within the range of between about 10 to 80 P & J, and most preferably within a range of between about 20 to 40 P & J. The hardness of the remaining thickness of the coating is in the range of between about 3 to 30 P & J and most preferably in the range of between about 5 to 20 P & J.

The resilient belts and coatings in accordance with the invention preferably have a coefficient of friction which is as low as possible to reduce the amount of heat generated under continual compression and reverse loading. In this manner, power consumption can be maintained at a minimum and the operating temperature of the resilient belt and coating will remain sufficiently low thereby improving the durability of the resilient material. It is possible, however, to provide additional cooling for the resilient belt or coating in the form of water and/or air jets or in the case where a press roll is provided with the resilient coating, by means of internal cooling of the roll.

Figure 12:
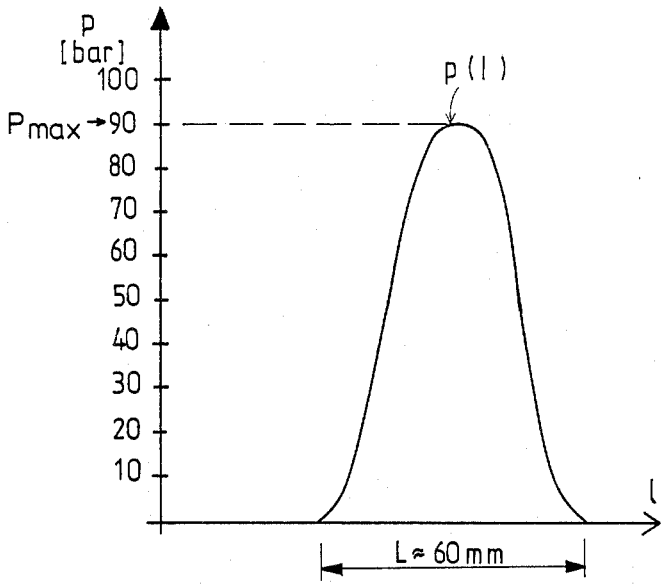
FIG. 12 is a graphical illustration of compression pressure obtained in a press nip in accordance with the invention.

Referring to FIG. 12, a typical example of a curve p(1) of the distribution of the compression pressure in a press nip along the length of the press nip in a nip provided with a resilient belt in accordance with the invention is illustrated. The pressure distribution curve illustrated in FIG. 12 was obtained in a test run performed by applicant's assignee in a test arrangement similar to that shown in FIGS. 1 and 7. The resilient belt 100 used in the test was formed of polyurethane material provided with a reinforcement fabric and having the thickness of 10 mm in its uncompressed state. The length L of nip $N_1$ was 60 mm and the linear load in the nip $N_1$ was 360 kN/m. At the maximum compression pressure $P_{max}$ of 90 bars, the compression of the resilient belt 100 was about 1.5 mm taking into account the compression of the press felts 15 and 25. The hardness of the outer face 104 of the resilient belt 100 facing the web W and contacting the inner surface of felt 15 was about 20 P & J. The curve p(1) was obtained by means of a power detector rotating along with the press roll. An electric signal produced by the power detector was transmitted to an oscilloscope synchronized with the rotation of the rolls in the nip and the data for curve p(1) was obtained from the oscilloscope.

A relatively high rate of compression is obtained in a nip provided with a resilient belt and/or a resilient coating in accordance with the invention. A high compression rate advantageously equalizes variations in compression pressure and flaws in the surface of the web. The relatively high compression of the resilient material of the resilient loop component running through the nip results in a relatively large length L of the nip. The nip length can also be increased by increasing the diameters of the press rolls. The length of a nip in accordance with the invention is generally within a range of between about 40 to 150 mm and most preferably is within a range of between about 40 to 100 mm. The object of providing a softer outer surface for the resilient material of the resilient loop component in accordance with the invention facing the web and the resulting advantageous localized spring action properties is the equalization of small-scale differences in compression pressure. The material of the resilient belt in accordance with the invention and/or of the surface layer of the resilient coating facing the web is chosen so that the dimension, e.g. the diameter, of the smallest localized area in which compression pressure is efficiently compensated, analogous to the length of the half-wave of pressure variation (corresponding to the upper limit frequency of the disturbance) is within a range of between about 0.2 to 6 mm, and preferably in the range of between about 1 to 3 mm.

The harder layer used in a resilient belt or resilient coating in accordance with the invention provides the resilient component with necessary strength and, moreover, equalizes larger scale deviations in compression pressure having dimensions greater than the value of the above-mentioned upper limit (6 mm). Moreover, the compression of the harder inner layer acts to lengthen the press nip.

It is seen from the foregoing that the resilient loop component in accordance with the invention is characterized by a certain layered structure wherein each layer has its own specific function. As noted above, a layered structure does not necessarily require discrete separate hardnesses of corresponding discrete layers having distinct boundaries between them. Rather, the invention also includes resilient components wherein the hardness and other properties vary in the thickness direction in a smooth continuous manner. Besides functioning to equalize larger scale variations in compression pressure, the harder framework layer of the resilient component provides the latter with necessary strength and dimensional stability. These requirements are relatively high and for this reason the thickness of the framework layer must, generally, be greater than 50%, and most preferably about 60 to 70%, of the total thickness of the resilient component. According to the invention, the resilient component may be provided with more than two layers, such as 5 to 10 layers situated one above the other.

Since the length of the nip can be increased by means of the resilient component of the invention, it is also possible to increase the compression impulse of the nip (compression force x compression time) without exceeding a maximum compression pressure, which may be about 110 bars. In this manner, the dewatering of the web can be intensified. As is well known, it is the magnitude of the compression impulse that determines the dry solid content which can be obtained by a press nip or group of nips. By means of the invention, it is even possible to lower the maximum compression pressure thereby increasing the service life of the press felts and the resilient group component and reducing the possibility of web breakage. The maximum compression pressure $P_{max}$ within the scope of the invention is in the range of between about 40 to 160 bars and preferably within the range of between about 60 to 120 bars. The lower limits of the pressure ranges are essentially applicable to limited-flow paper qualities while the upper limits are essentially applicable to limited-compression paper qualities.

The increased length of the nip obtained by means of the resilient component of the invention increases the dry solid content of the web after the press, especially in the case of limited-flow paper qualities such, for example, as liner board.

The length of a press nip provided with a resilient component in accordance with the invention can be in the range of between about 40 to 150 mm when the diameters of the press rolls are within the range of between about 1000 to 2000 mm and when the thickness of the resilient loop component is within the range of between about 5 to 25 mm in the case of a resilient belt or 10 to 40 mm in the case of a resilient coating. From the durability standpoint of the resilient loop component, the nip length is generally restricted to about 100 mm. For comparison purposes, it is noted that the length of a hard nip formed by a pair of hard-faced rolls through which one or two conventional press felts are run is in the range of between about 20 to 30 mm.

Maximum compression pressure $P_{max}$ is especially significant in the case of limited-compression paper qualities wherein the dry solid content which can be obtained by means of a press is essentially determined by the maximum $P_{max}$ of the compression pressure curve of the press nip. For example, this is the case for newsprint. With modern conventional press felts, the durability and vibrational properties restrict the maximum compression pressure to about 80 to 120 bars. By means of the invention, this maximum pressure can be maintained if required and, moreover, the nip can be extended so that an improved compression is obtained not only in the case of limited-compression paper qualities, but also in the particular case of limited-flow paper qualities.

The range of loading of a nip N in accordance with the invention is generally between about 50 to 500 kN/m and most preferably in the range of between about 150 to 360 kN/m.

The construction of the resilient belts 100 and 120 as well as the resilient coatings 110, 130, 140 and 150 have been described above as comprising a softer outer layer and a harder inner layer and wherein a reinforcement layer or layers is provided within the harder layer, if required. As also noted above, the invention can also be carried out by a construction wherein no separate discrete layers are provided in the structure of the resilient belt or coating but where the hardness of the structure changes in a continuous, smooth manner in the direction of thickness of the belt or coating.

Figure 13A:
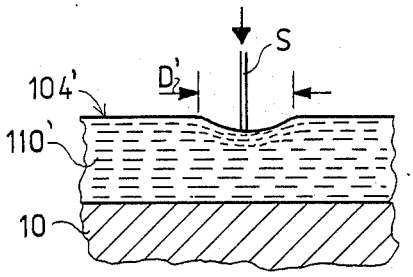
FIGS. 13A and 13B are schematic illustrations of one possible test by means of which the suitability of the surface properties of a resilient material for use as the resilient loop component of the invention can be determined.
Figure 13B:
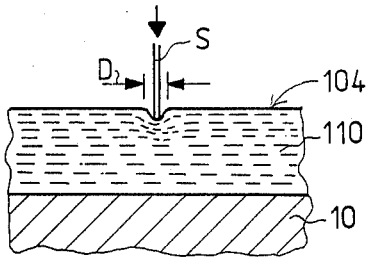

FIGS. 13A and 13B illustrate a simple test by means of which it is possible to determine whether the resilient material concern is suitable for purposes in accordance with the invention. Referring to FIG. 13A, the coating 110' of roll 10 is tested by means of a probe S comprising a pin having a blunt end whose diameter is about 0.2 to 1 mm. The surface 104' of the coating 110' (or of a corresponding belt) is seen to be not suitable for the purposes of the invention because the diameter D′ of the compression recess produced by pushing the end of the probe against the surface 104′ is larger than about 6 mm. Referring to FIG. 13B, the local compression properties of the outer surface 104 of the coating 110 of the roll 10 are satisfactory for use in the invention since upon depression by means of the probe S, the diameter D of the compression recess is only about 1 to 3 mm.

In addition to the use of a resilient belt or resilient coating in accordance with the invention, the equalization of the compression pressure sought by the invention may also be improved to some extent by means of thick dewatering felts having thick and dense nap layers as well as by means of transfer felts comprising an ordinary felt impregnated with a resin.

Obviously, numerous modifications and variations of the pressent invention are possible in the light of the above teachings. It is therefore to be understood that within the scope of the claims appended hereto, the invention may be practiced otherwise than as specifically disclosed herein.

What is claimed is:

1. A method in a press section of a paper machine for equalizing compression pressure acting on a web passing through a press nip formed by two opposed press rolls and through which at least one water-receiving press fabric passes having a surface directly contacting a surface of the web for receiving water pressed from the web in said press nip, comprising the steps of:

equalizing small size variations in the compression pressure acting on the web, small-size variations being in the range of up to about 6 mm, by passing at least one resilient loop component through said press nip, said resilient loop component having a thickness and an outer surface layer facing the web, and wherein said outer surface layer of said resilient loop component facing the web has a hardness in the range of between about 10 to 80 P & J, and equalizing larger variations in the compression pressure acting on the web, said larger variations being greater than about 6 mm, by providing said resilient loop component with a framework layer within the thickness thereof, said framework layer of said resilient loop component having a thickness greater than 50% of the thickness of said resilient loop component and a hardness substantially greater than the hardness of said outer surface layer of said resilient loop component facing the web, said framework layer hardness being in the range of between 5 to 30 P & J.

2. The method of claim 1 wherein said outer surface layer of said resilient loop component facing the web has a hardness in the range of between about 20 to 40 P & J.

3. The method of claim 1 wherein the compression pressure acting on the web in said press nip applies a linear load to the web in the range of between about 50 to 500 kN/m.

4. The method of claim 3 wherein the compression pressure acting on the web in said press nip applies a linear load to the web in the range of between about 150 to 360 kN/m.

5. The method of claim 1 including the further step of selecting the radii of said press rolls, the material of which said resilient loop component is formed, and a linear load acting on the web in said press nip, so that the length of said press nip is within a range of between about 40 to 150 mm and the maximum compression pressure in said press nip is within a range of between about 40 to 60 bars.

6. The method of claim 1 including the further step of selecting the radii of said press rolls, the material of which said resilient loop component is formed, and a linear load acting on the web in said press nip, so that the length of said press nip is within a range of between about 40 to 150 mm and the maximum compression pressure in said press is within a range of between about 60 to 120 bars.

7. The method of claim 1 wherein said resilient loop component comprises a resilient belt.

8. The method of claim 1 wherein said resilient loop component comprises a resilient coating applied around at least one of said press rolls.

9. The method of claim 1 wherein said outer surface layer of said resilient loop component facing the web has a hardness in the range of between about 20 to 40 P & J and said framework layer of said resilient loop component has a hardness in the range of between about 10 to 20 P & J.

* * * * *